United States Patent [19]

Gueret

[11] 4,446,879

[45] May 8, 1984

[54] RECEPTACLE FOR MAKE UP POWDER

[75] Inventor: Jean-Louis H. Gueret, Paris, France

[73] Assignee: "L'Oreal", Paris, France

[21] Appl. No.: 415,934

[22] Filed: Sep. 8, 1982

[30] Foreign Application Priority Data

Sep. 25, 1981 [FR] France ..... 81 18090

[51] Int. Cl.[3] ..... A45D 33/00

[52] U.S. Cl. ..... 132/82 B; 132/82 G; 132/82 R

[58] Field of Search ..... 132/79, 81, 82, 83; 401/122, 126, 129, 191; 15/169, 184

[56] References Cited

U.S. PATENT DOCUMENTS

| | | | |
|---|---|---|---|
| 882,668 | 3/1908 | Davis | 132/81 |
| 1,643,815 | 9/1927 | Lesquendieu | 401/126 |
| 2,990,834 | 7/1961 | Amen | 132/79 R |

*Primary Examiner*—C. Fred Rosenbaum
*Assistant Examiner*—Sherri E. Vinyard
*Attorney, Agent, or Firm*—Cushman, Darby & Cushman

[57] ABSTRACT

A make-up powder receptacle includes first and second compartments intercommunicated by a passage to allow transfer of a dose of powder from the first compartment to the second compartment past a partition between the compartments. The second compartment has a duct in it to receive an applicator or a stopper, and the first compartment has a filling hole closed by a substantially irremovable plug.

10 Claims, 5 Drawing Figures

FIG. 1
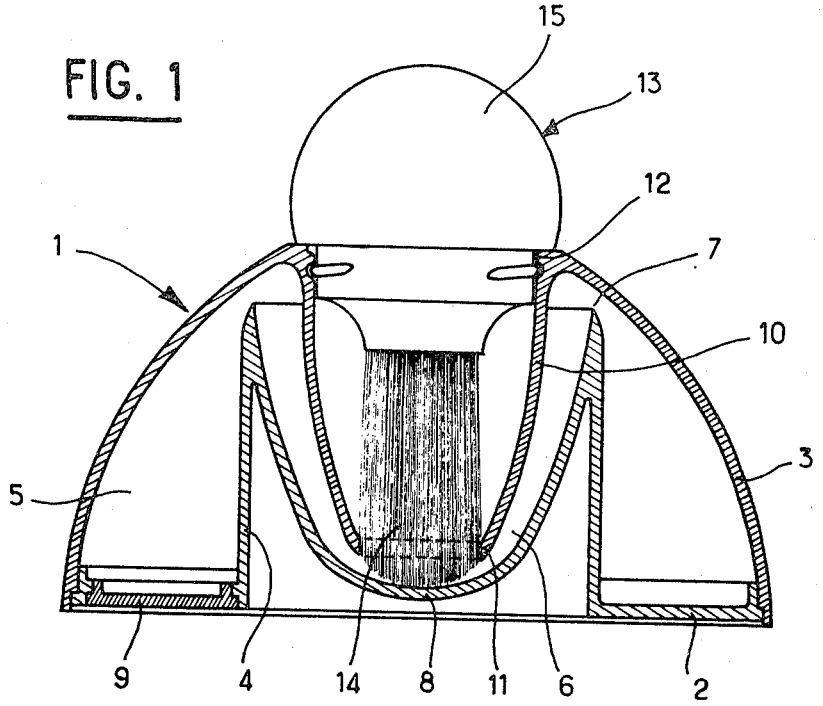
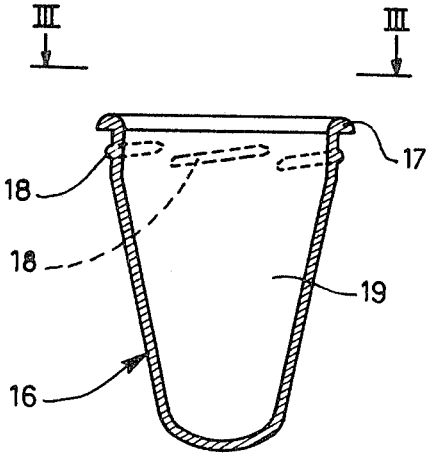
FIG. 2
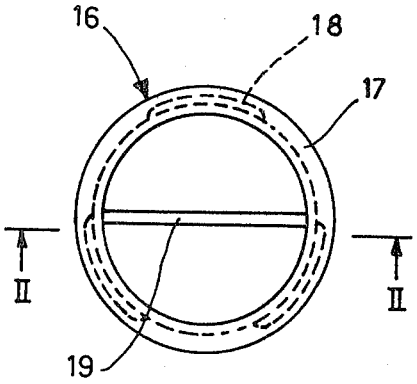
FIG. 3

RECEPTACLE FOR MAKE UP POWDER

The present invention concerns a receptacle for use in holding and dispensing a non-compacted make up powder in a substantially fluid state.

It is known that make-up powders are frequently used in a compacted state in the form of a disc, for instance, placed within a make-up powder compact (that is to say, a small, generally flat casing formed by two elements hinged to each other, one of the two elements carrying the compacted powder disc and the other carrying a small mirror). The application of the powder on the face is effected by means of a puff coming to be accommodated within the powder compact.

More recently, receptacles have been marketed which contain the make-up powder in a fluid, non-compacted state. Such receptacles comprise a closing lid, a casing and a small applicator puff accommodated between the lid and the casing. Such a receptacle for make-up powder has a two-fold drawback: firstly, when the lid of the receptacle is withdrawn with a view to taking up the powder by means of the small puff, the make-up powder in a fluid state is in danger of being dispersed outside the receptacle in the slightest of air currents or following clumsy handling by the user. Secondly, the small puff used as an applicator does not allow a satisfactory dosing of the quantity of the powder to be taken up.

The object of the present invention is to remedy this two-fold drawback. According to the present invention there is provided a make-up powder receptacle for containing powder substantially in a fluid state, comprising an internal partition which divides the receptacle into two compartments which intercommunicate via a passage between the free edge of the partition which is remote from the bottom of the receptacle and a wall of the said receptacle which is adjacent to said free end, one of the two compartments being provided with a duct capable of receiving an applicator. The powder is passed from the first compartment to the second by simply turning the receptacle upside down. Thus the powder remaining in the first compartment is not subjected to a compacting action exerted by the applicator at the time of take up and may remain in its fluid state. Moreover, the second compartment preferably contains only a small portion of the powder originally located within the receptacle which, of course, contributes towards limiting the risks of an excessive take up of the make-up powder. Moreover, the second compartment is traversed by the inner duct ending in the immediate vicinity of its bottom and intended to accommodate a brush as the applicator. In this way, the take up of the make-up powder by the tuft of bristles of the brush is effected within the receptacle so that there is therefore no risk of dispersing the powder outside the said receptacle.

According to another advantageous characteristic, the inner duct may have a diameter which progressively decreases towards the bottom of the said one compartment. This duct allows the initial diameter of the tuft of bristles of the brush to be reduced so that the take up of the powder is effected on the central portion of the tuft end and not over the whole of its surface. This makes it possible to prevent an unduly large take up of the make-up powder by the tuft of bristles and since, moreover, the diameter of the duct increases towards the outside of the receptacle, the bristle tuft of the brush may, as the latter is being extracted, progressively reassume its initial diameter which it had at the outset and thus avoid a sudden release of the bristles of the tuft and hence a splatter of the powder that has been taken up.

In an advantageous embodiment of the make-up powder receptacle according to the invention, the duct is practically disposed entirely within the receptacle. The duct is of a substantially conical shape with the diameter of its circular cross-section decreasing towards the bottom of the said one compartment wherein it is located. The duct is preferably joined at one of its ends to the upper side of the receptacle, the other end of the said duct being slightly spaced from the bottom of the said one compartment wherein it is situated.

According to another advantageous characteristic, the other of the two compartments, which is not traversed by the duct, comprises on its bottom a filling hole substantially irreversibly obturated by a plug. The make-up powder receptacle is advantageously made of a moulded plastic material and the stoppering plug, also made of a moulded plastic material, is fixed in place by ultrasonic welding.

The applicator associated with the make-up powder receptacle according to the invention is advantageously a brush including a bristle tuft having a maximum diameter which, when the brush is not subjected to any constraint, is greater than the diameter of the end of the duct which is adjacent to the bottom of said one compartment.

According to another advantageous characteristic of the invention, provision is made for the brush to be detachably fixed within the duct. In a first variant, the detachable fixing means consist of screw formations such as a continuous or discontinuous male thread provided in relief on a shaft of the brush, and cooperable with a female thread of complementary shape provided on the internal wall of the duct. In a second variant, the detachable fixing means consist of a cap hinged to the top wall of the make-up powder receptacle, the said cap preferably having a shape complementary to the free end of a handle of the brush which it accommodates, and comprising closing devices such as a catch cooperating with a notch arranged on the top wall of the receptacle.

The make-up powder receptacle according to the invention is advantageously provided with a hollow stopper in the form of a resilient cup intended to be screwed inside the duct of the said receptacle.

In order that the present invention may more readily be understood, there will be described below two embodiments by way of purely illustrative and non-restrictive examples shown in the attached drawings. In these drawings:

FIG. 1 is an axial cross section of a make-up powder receptacle according to the invention;

FIG. 2 is an axial cross section along the line II—II of FIG. 3 but showing only the closing stopper of the receptacle of FIG. 1;

FIG. 3 is a top plan view along the line III—III of FIG. 2 and showing the stopper of FIG. 1;

Figure 4:
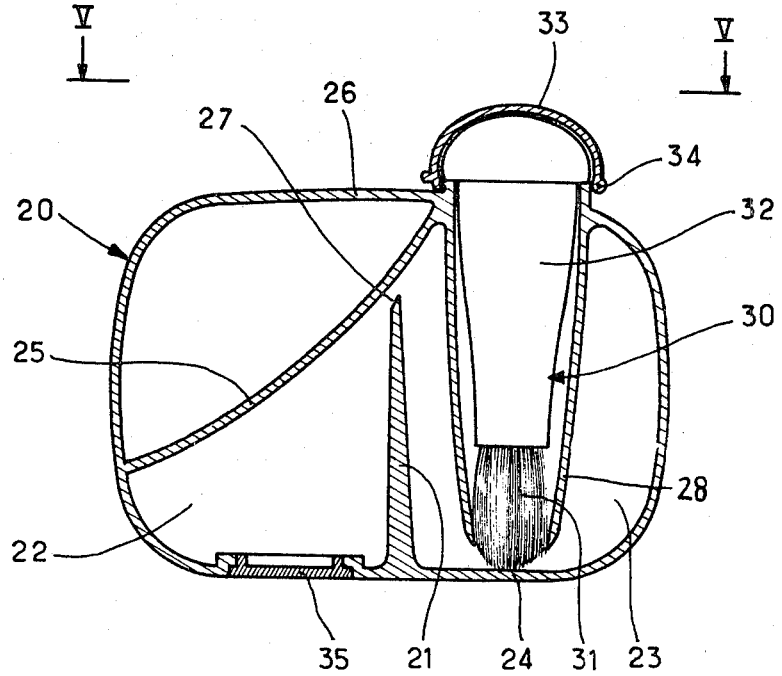
FIG. 4 is an axial cross-section along the line IV—IV of FIG. 5, showing a make-up powder receptacle according to another embodiment of the invention.

Referring to FIG. 1 of the drawings, it will be seen that a receptacle intended to enclose uncompacted make-up powder in a fluid condition has been designated by 1 in its entirety. Receptacle 1 has a hemispherically shaped top wall 3. A cylindrical partition 4 divides the internal space of receptacle 1 into two compartments, namely a peripheral compartment 5, around a central compartment 6. The two compartments 5 and 6 communicate in their upper parts via an annular passage 7 arranged between the rim of the cylindrical partition 4 and the rounded upper side 3 of the receptacle 1.

The central compartment 6 is provided with a concave curved bottom 8, and the peripheral compartment 5 with an annular flat bottom 2. In the flat bottom 2 of the peripheral compartment 5 is a filling hole which is obturated by a plug 9 irremovably fixed in place by ultrasonic welding.

In the central portion of the rounded top wall 3 of the receptacle is a duct 10 which is open at its lower and upper ends 11, 12 and which penetrates inside the central compartment 6. The duct 10 extends substantially over the whole height of the central compartment 6 and terminates at its lower end 11 in the immediate vicinity of the curved concave bottom 8 of the said compartment. It is of a substantially conical shape and has an inner diameter decreasing along a direction away from its upper end 12 where it is connected to the rounded upper wall 3 of the receptacle towards its lower end 11 situated near the concave curved bottom 8.

The receptacle 1 is fitted with an applicator consisting of a brush 13 whose shape is similar to that of a shaving brush. The brush 13 is formed by a tuft of bristles 14 joined at the end to a rounded handle 15. The handle 15 of the brush is provided with an interrupted male thread intended to cooperate with an interrupted female thread on the side of the conical duct 10 to allow the brush 13 to be screwed into the inside of the said duct. The tuft of bristles 14 of the brush 13 has, in the absence of any constraint, an approximately frustoconical shape; the tuft of bristles 14 is dimensioned in such a way that its maximum initial diameter should be greater than the inner diameter of the lower end 11 of the conical duct 10. Moreover, the length of the tuft of bristles 14 is chosen in such a way that when brush 13 is fitted within the conical duct 10 and its handle 15 comes to bear on the top end 12 of the conical duct 10 the bristles come substantially into contact with the curved concave bottom 8 of the central compartment 6.

In this example, the receptacle 1 is made by assembling three moulded plastic components, namely a first component delimiting the curved top wall 3 and the conical duct 10 of the receptacle, a second component delimiting the bottoms 2 and 8 of the two compartments 5 and 6 as well as the cylindrical partition 4, and a third component forming the stoppering plug 9 for the filling hole.

Filling of receptacle 1 with the make-up powder may be effected in the factory by the manufacturer, by means of the filling hole in the annular bottom 2 of the peripheral compartment 5. The filling hole is then stoppered by means of plug 9. Receptacle 1 may be marketed in association with the brush 13 which then performs the function of a closing stopper for the conical duct 10.

The make-up powder is initially contained in the peripheral compartment 5. When the receptacle 1 is inverted, a dose of the powder passes from the peripheral compartment 5 into the central compartment 6 and comes to accumulate under the tuft of bristles 14 of the brush 13. The user can effect several take ups by means of brush 13 before again inverting the receptacle 1 to obtain a fresh dose. Within the conical duct 10, the tuft of bristles 14 is subjected to a reduction of its initial diameter so that the take up of the powder is effected only at the centre of its tip. This has the advantage of avoiding the take up of an unduly large quantity of powder by the brush. Moreover, since the diameter of the conical duct 10 increases progressively towards the outside of the receptacle, the tuft of bristles 14 may reassume its initial diameter progressively when the brush is being withdrawn from receptacle 1, thereby avoiding any sudden release of the tuft of bristles 14 and preventing the make-up powder which is taken up from being blown off.

Receptacle 1 may also be marketed without the associated brush 13, in this case in the form of a refill container. The brush duct 10 is in this case obturated by means of a hollow stopper 16 (FIGS. 2 and 3) in the form of a flexible cup which fits snugly against the inner side of the conical duct 10. At its upper end, the hollow stopper 16 is provided with a peripheral flange 17 intended to bear on the top edge 12 of the conical duct 10. Three male thread starts 18 allow the hollow stopper 16 to be screwed into the conical passage 10. The hollow stopper 16 is moreover provided with a rigidifying central partition 19 serving as grippable means for the screwing or unscrewing of the hollow stopper 16.

Figure 5:
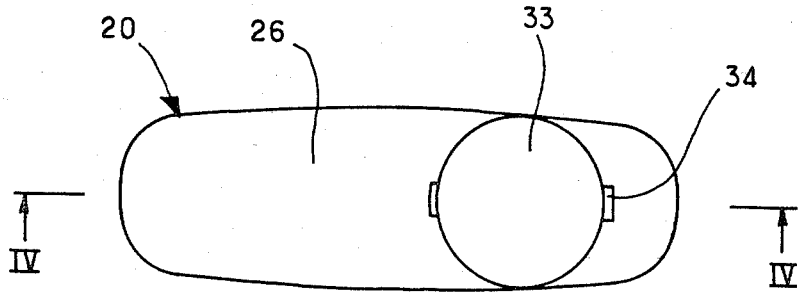
FIG. 5 is a top view, along the line V—V of FIG. 4, of the powder receptacle of FIG. 4.

In FIGS. 4 and 5, there has been shown another embodiment of the make-up powder receptacle according to the invention. Such receptacle has been designated in its entirety as 20. It is of a flat, rectangular shape with rounded edges and comprises internally a transverse partition 21 which divides it into two compartments 22, 23. The partition 21 is joined to the bottom 24 of the receptacle 20. Provision is made for an internal oblique wall 25 joining the top 26 of the receptacle to the transverse side wall arranged on the same side of the receptacle as compartment 22. The oblique internal wall 25 is slightly curved so as to be converse towards the bottom 24 of the receptacle; it extends on either side of the partition 21 and therefore in part delimits both of the two compartments 22, 23.

The oblique internal wall 25 and the inner partition 21 delimit a passage 27 communicating the two compartments 22 and 23. The oblique internal wall 25 and the partition 21 converge towards the passage 27.

There is a filling hole in the part of the bottom 24 situated on the same side as the compartment 22. This hole is obturated by a plug 35 made of a plastic material which is irremovably fixed in place by ultrasonic welding.

Within the compartment 23, and substantially over its whole height, is an oblique duct 28 which terminates in the immediate vicinity of the bottom 24 of the receptacle 20. The upper end of the duct 28 slightly projects above the top 26 of the receptacle. The circular section of the duct 28 slightly decreases in a direction from its upper end towards its lower end.

A brush 30 to be fitted within the duct 28 is composed of a tuft of natural bristles 31 and a handle 32. The rounded end of the handle 32 forms an annular shoulder abutting the upper end of the oblique duct 28 once the brush 30 has been lowered completely within the duct. In this position, the tip of the tuft of bristles 31 comes substantially into contact with bottom 24 of the receptacle. As in the previous embodiment the cross-section of the duct 28 is chosen so as to allow a progressive reduction of the inner diameter of the tuft of bristles 31 as the brush 30 is introduced into the duct 28.

The rounded end of the handle 32 of the brush is held in contact on the upper end of duct 28 by means of a cap 33 articulated by a hinge 34 to the side wall of the receptacle. The cap 33 takes the shape of the free rounded end of the brush handle 32 and is kept in a closed position by conventional means such as a catch engageable as a snap fit in a notch provided for this purpose on the wall of the receptacle.

The make-up powder receptacle of FIGS. 4 and 5 has substantially the same advantages as that of FIG. 1. The make-up powder is introduced into the compartment 22 by the filling hole, this hole being subsequently closed in an irreversible manner by the ultrasonic welding of the plug 35. When receptacle 20 is inverted, the make-up powder is caused to pass from the large storage compartment 22 to the smaller dispensing compartment 23, this transfer being facilitated by the obliquity of the internal wall 25. In view of the reduction of the initial diameter of the tuft of bristles 31 by the duct 28, only the central portion of the end of the duct 31 receives make-up powder, which avoids the take up of an unduly large quantity of the powder. The powder take up is effected within the enclosed interior of receptacle 20 and thanks to its particular shape, the duct 28 allows the tuft of bristles 31 to reassume progressively its initial diameter when the brush 30 is withdrawn from the receptacle.

It shall be duly understood that the embodiments described above are in no way restrictive and may give rise to any desirable modifications without thereby departing from the scope of the present invention as defined by the following claims.

I claim:

1. A make-up powder receptacle for containing powder substantially in a fluid state, comprising:

(a) a housing having a top and a bottom;

(b) an internal partition which divides said housing into first and second compartments;

(c) passage means intercommunicating said first and second compartments, said partition having a free edge adjacent a part of said housing and said passage means being arranged between said free edge of the partition and said part of the housing, said free edge of the partition being remote from said bottom of the housing;

said first compartment having a bottom portion remote from said free edge and wall means extending from said top of said housing, said wall means and said internal partition defining a pathway therebetween with said pathway extending from said free edge to a point adjacent but spaced from said bottom portion of said first compartment;

(d) said wall means defining a duct in said first compartment for the take-up of the make-up powder by an applicator.

2. A receptacle according to claim 1, wherein said duct is disposed substantially entirely within the receptacle.

3. A receptacle according to claim 1, wherein the duct is substantially conical in shape, and has a circular cross section whose diameter decreases along a direction towards the bottom of said first compartment wherein said duct is situated.

4. A receptacle according to claim 1, wherein the duct has first and second ends, and including means joining said first end to said top of the housing.

5. A receptacle according to claim 4, and further including an applicator comprising a brush having a handle, and a tuft of bristles of a maximum diameter which, when the brush is not subjected to any constraint, is greater than the diameter of said second end of duct.

6. A receptacle according to one of claims 1 to 4, further including an applicator comprising a brush adapted to be removably secured within said duct, said brush having a handle dimensioned and configured for screwing into said duct.

7. A receptacle according to one of claims 1 to 4, and further including an applicator comprising a brush, cap means configured to hold said brush removably in said duct, and means articulating said cap to the top of the housing.

8. A receptacle according to any one of claims 1 to 5, wherein said second compartment, which is not traversed by the duct, has a bottom wall, means defining a filling hole in said bottom wall, and a substantially irremovable plug obturating said filling hole.

9. A receptacle according to any one of claims 1 to 5, wherein said partition and said part of the housing, which together define said passage means intercommunicating said first and second compartments, are convergent along said passage means.

10. A receptacle according to one of claims 1 to 5, further including a hollow stopper comprising a resilient cup adapted to be secured in said duct.

* * * * *